US005537140A

United States Patent [19]

Hayashi et al.

[11] Patent Number: 5,537,140

[45] Date of Patent: Jul. 16, 1996

[54] COLOR DIRECT THERMAL PRINTING METHOD AND DIRECT COLOR THERMAL PRINTER

[75] Inventors: Junji Hayashi; Masamichi Sato, both of Tokyo, Japan

[73] Assignee: Fuji Photo Film Co., Ltd., Kanagawa, Japan

[21] Appl. No.: 986,090

[22] Filed: Dec. 4, 1992

[30] Foreign Application Priority Data

Dec. 6, 1991 [JP] Japan ..... 3-348516
Feb. 17, 1992 [JP] Japan ..... 4-029336

[51] Int. Cl.[6] ..... B41M 5/34; B41M 5/28; B41J 2/325

[52] U.S. Cl. ..... 347/175

[58] Field of Search ..... 346/76 R, 76 PH, 346/1.1; 430/146, 148, 348; 347/172, 173, 174, 175; 400/120.02, 120.03

[56] References Cited

U.S. PATENT DOCUMENTS

| | | | |
|---|---|---|---|
| 4,003,058 | 1/1977 | Entwistle | 346/46 |
| 4,109,243 | 8/1978 | Day et al. | 346/33 ME |
| 4,214,590 | 7/1980 | Patnoi et al. | 346/33 ME |
| 4,483,188 | 11/1984 | McTamaney et al. | 346/33 WL |
| 4,734,704 | 3/1988 | Mizutani et al. | 346/76 PH |
| 4,806,950 | 2/1989 | Sekine et al. | 346/76 PH |
| 4,833,488 | 5/1989 | Mizutani et al. | 346/76 PH |
| 5,244,705 | 9/1993 | Tsurushima et al. | 346/135.1 |
| 5,373,346 | 12/1994 | Hocker | 346/33 WL |

FOREIGN PATENT DOCUMENTS

| | | |
|---|---|---|
| 0219969 | 9/1991 | Japan . |
| 0221468 | 9/1991 | Japan . |

*Primary Examiner*—Huan H. Tran

[57] ABSTRACT

A color thermal recording medium has a cyan thermosensitive coloring layer, a magenta thermosensitive coloring layer, and a yellow thermosensitive coloring layer, respectively laminated on a supporting material in this order from the side of the supporting material. The upper layer has a higher thermal recording sensitivity, and is colored with lower heat energy. The color thermal recording medium is thermally recorded by three thermal heads by a one-pass method. The top yellow thermosensitive coloring layer and the adjacent magenta thermosensitive coloring layer are thermally recorded at lower voltages, which are applied to the thermal printers, than the voltage applied for the cyan thermosensitive coloring layer. In this case, the cooling time is shortened within a range for allowing thermal hysteresis to be relieved, and the image pulse duration is set longer. Instead of adjusting the application voltages, the mean resistance values of heating elements may be changed. A color thermal printer is supplied with compressed image data from an input terminal. The compressed image data is temporarily stored in an input buffer memory, and supplied to an expander circuit to expand the compressed image data. By using the expanded image data, a multi-color image is printed out.

27 Claims, 7 Drawing Sheets

COLOR DIRECT THERMAL PRINTING METHOD AND DIRECT COLOR THERMAL PRINTER

BACKGROUND OF THE INVENTION

1. Field of the Invention

The present invention relates to a direct color thermal printing method using a thermal color recording medium which is colored when heated. The present invention also relates to a direct color thermal printer.

2. Description of the Related Art

As a thermal color recording medium, there is known a direct color thermal recording medium (hereinafter simply called a thermal recording medium) disclosed, for example, in U.S. Pat. Nos. 4,734,704 and 4,833,488 (both corresponding to Japanese Laid-open Patent Application No. 61-213169), having thermosensitive coloring layers for yellow, magenta and cyan which are laminated or formed on a supporting material in this order from the top side of the medium. In this type of thermal recording medium, the heat sensitivities of the thermosensitive coloring layers become lower as the distance from the upper surface increases. Furthermore, the coloring layers have properties that each coloring layer is optically fixed by electromagnetic rays of a respective specific wave length range.

When recording a multi-color image on the above-described thermal color recording medium, a thermal head having a plurality of heating elements arranged in a line is used. First, a yellow frame of a multi-color image is thermally recorded in the coloring layer for yellow, or the first layer that is disposed on the uppermost of the coloring layers, while the thermal head is moved relative to the thermal color recording medium. After recording a yellow frame of the multi-color image in the first layer in this way, the thermal color recording medium is exposed to light having a wave length range by which a diazonium salt compound still contained in this first layer is decomposed. Thereby, the first layer is optically fixed by decomposing the diazonium salt compound that has a capacity for coupling. Next, a magenta frame of the multi-color image is recorded in the coloring layer for magenta, or the second layer that is disposed in the second position from the top side of the medium, by using a higher heat energy than that applied for the yellow frame recording. Thereafter, the second layer is optically fixed by being exposed to light having a wave length range that decomposes a diazonium salt compound still contained in the second layer and having a capacity for coupling. Then, the highest heat energy is applied to the thermal color recording medium, so as to record a cyan frame of the multi-color image in the coloring layer for cyan, that is, the third layer disposed at the bottom of the coloring layers. Finally, light having a wave length range that decomposes a diazonium salt compound still having a capacity for coupling, is applied to optically fix the third layer.

In a one-pass method, a multi-color image is thermally recorded by passing a thermal recording medium once through a path along which three thermal heads are mounted at a predetermined interval. With this one-pass method, although the recording time can be shortened, three thermal heads are driven substantially at the same timing. Therefore, it is necessary to use a power supply circuit for powering three thermal heads substantially at the same timing. It is also necessary to maintain constant the transport speed of a thermal recording medium for each color recording. Under such recording conditions, the necessary power to be supplied to three thermal heads becomes three times as large as a conventional one-head three-pass method, although the power supply period is short or in one recording cycle (one line recording). An important issue of reducing maximum instantaneous power consumption occurs, from the view point of reducing the size and cost of an apparatus.

Another issue to be considered is a paper feed speed. A paper feed speed v3 is determined depending on one cycle time necessary for the thermal recording of the cyan thermosensitive coloring layer or the third layer requiring the largest heat energy, and the other paper feed speeds v1 and v2 for the thermal recording of the yellow and magenta thermosensitive coloring layers are adjusted, based upon the paper feed speed V3. From this point of view, it is desired to provide a suitable control method capable of reducing heal loss of the thermal heads for recording the upper two coloring layers. Namely, for the thermal recording of the yellow and magenta thermosensitive coloring layers requiring smaller heat energy than the lowest thermosensitive coloring layer, the time period while the thermal heads are actually powered during one recording cycle can be shorter than the cyan thermosensitive coloring layer, assuming a constant head application voltage is applied. As a result, the cooling time with the thermal heads not being powered is made longer. Accordingly, there occurs a problem that the thermal heads are cooled to an unnecessarily lower temperature until the next thermal recording starts.

A digital or analog image signal is supplied to a color thermal printer for printing a multi-color image on a thermal recording medium as represented by the multi-color image. The amount of image data of a multi-color image is relatively large. It takes a lot of time for transferring such image data to be printed to a color thermal printer. Furthermore, the capacity of a buffer memory for temporarily storing transferred image data becomes relatively large.

SUMMARY OF THE INVENTION

It is a principal object of the present invention to provide a direct color thermal printing method and color thermal printer, capable of reducing a power for driving a predetermined number of thermal heads substantially at the same timing by the one-pass method, to an amount much less than the predetermined number of times the power required by a one thermal head drive method.

It is another object of the present invention to provide a direct color thermal printing method and color thermal printer, capable of reducing heat loss of an applied power in the thermal recording of a plurality of thermosensitive coloring layers which are recorded by specific thermal heads substantially at the same timing.

It is a still further object of the present invention to shorten the transfer time of image data to a color thermal printer.

In order to achieve the above and other objects of the present invention, the direct color thermal printing method provides a setting of V1<V2<, . . . , <Vn, or R1>R2>, . . . , >Rn for the thermal recording of first to n-th thermosensitive coloring layers in the one-pass method by first to n-th thermal heads. V1 represents a voltage applied to the first thermal head for recording the first thermosensitive coloring layer, V2 represents a voltage applied to the second thermal head for recording the second thermosensitive coloring layer, and Vn represents a voltage applied to the n-th thermal head for recording the n-th thermosensitive coloring layer.

R1 represents an average or mean resistance value of heating elements of the first thermal head, R2 represents a mean resistance value of heating elements of the second thermal head, and Rn represents a mean resistance value of heating elements of the n-th thermal head.

According to an embodiment of the present invention, in a color thermal recording method of the one-pass type in which the recording speed for each thermosensitive coloring layer is constant, a voltage applied to each thermal head or a mean resistance value of heating elements of each thermal head, is changed with the thermal recording sensitivity. It is therefore possible to reduce the maximum power consumption when thermally recording all colors substantially at the same timing. The higher the thermal recording sensitivity of a thermosensitive coloring layer, the smaller heat energy per unit time of a thermal head is generated. Therefore, the width of an image pulse can be made larger correspondingly. It is possible to shorten the cooling time within the range allowing to relieve thermal hysteresis of a thermal head, for preventing heating elements from being cooled too much while reducing heat loss.

According to a color thermal printer for another embodiment of the present invention, there is provided an input terminal via which compressed digital image data is inputted, and data expanding means for expanding the compressed digital image data supplied from the input terminal. The image represented by the image data expanded by the data expanding means is printed out on a thermal recording medium. With this color thermal printer, compressed digital image data is used so that the amount of data to be transferred can be reduced as compared with non-compressed image data, and thereby shortening the data transfer time. Furthermore, the capacity of a buffer memory for temporarily storing transferred image data can be made relatively small.

BRIEF DESCRIPTION OF THE DRAWINGS

The above and other objects and advantages of the present invention will become apparent from the detailed description of the preferred embodiments when read in conjunction with the accompanying drawings, in which.

DETAILED DESCRIPTION OF THE PREFERRED EMBODIMENTS

Figure 1:
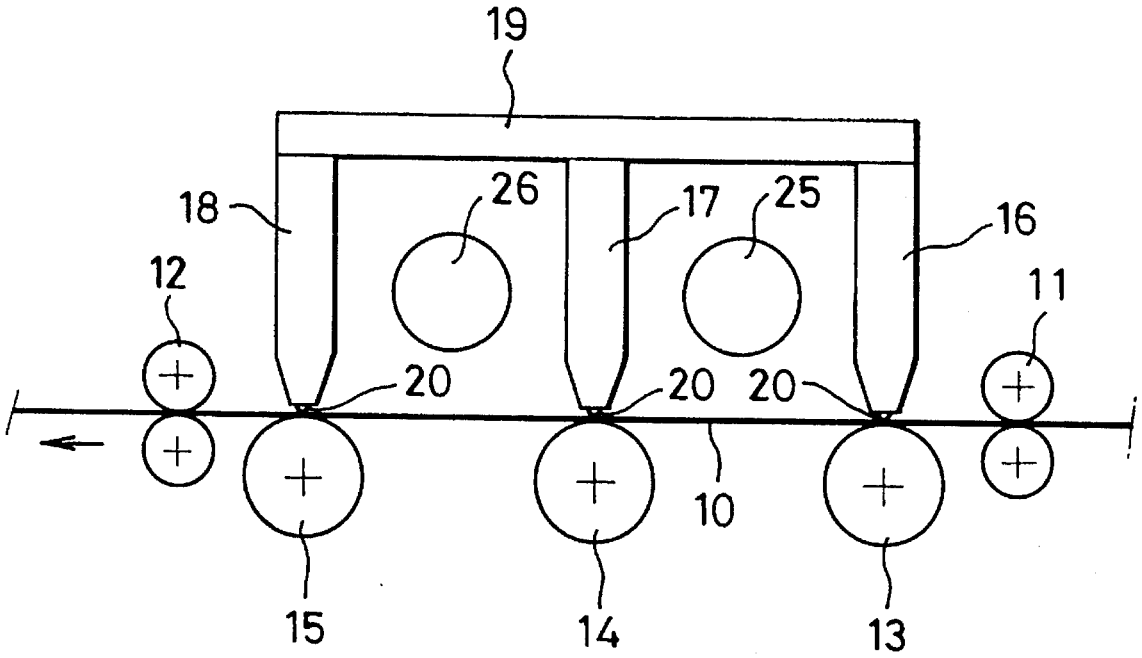
FIG. 1 is a schematic diagram of a color thermal printer for an embodiment of the present invention.
Figure 4:
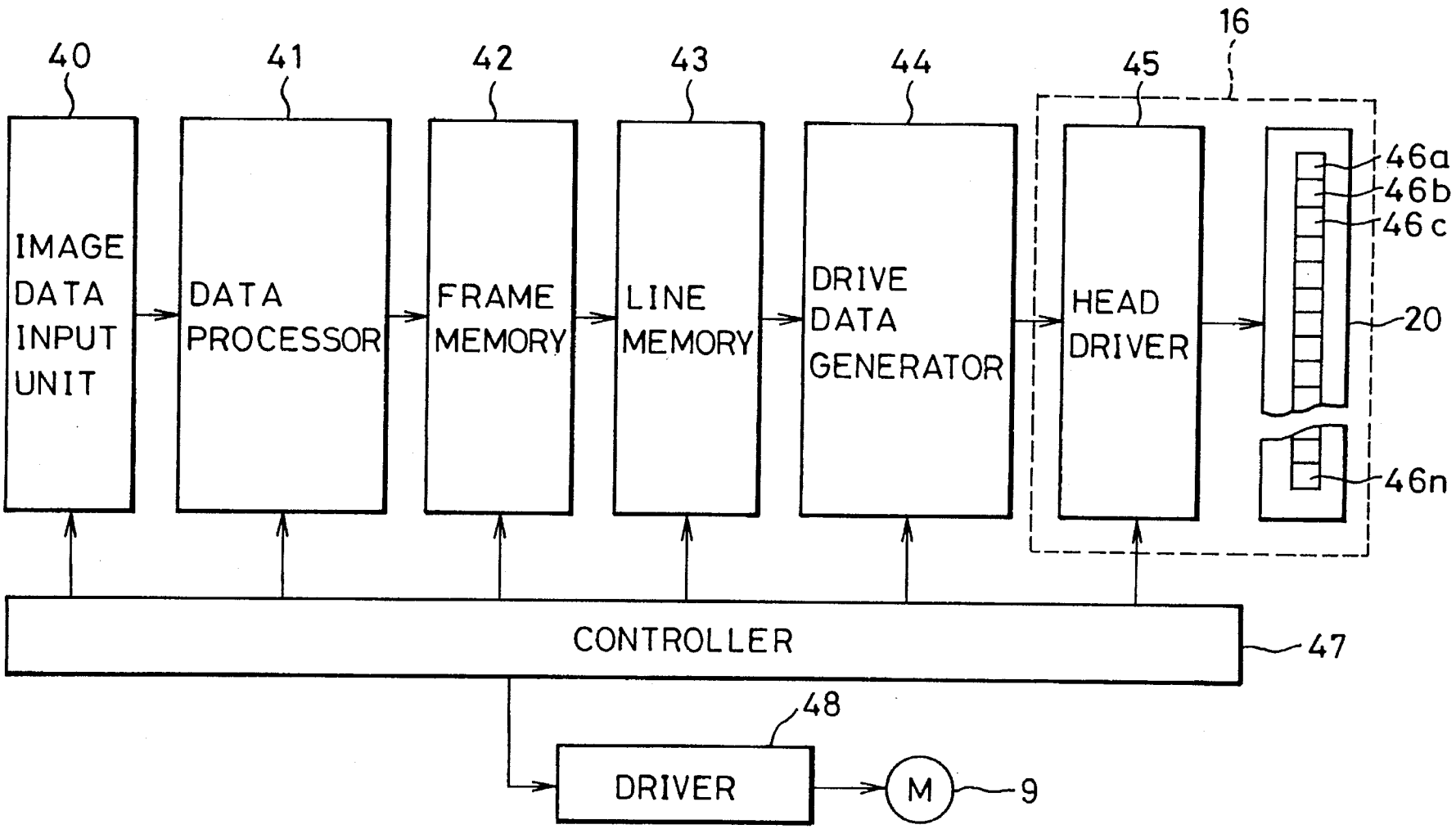
FIG. 4 is a block diagram showing the electric circuit of the color thermal printer for an embodiment of the present invention.

FIG. 1 shows a color thermal printer for recording a multi-color image on a thermal recording medium 10 having three thermosensitive coloring layers. The thermal recording medium 10 is transported at a constant speed by transport roller pairs 11 and 12 which are rotated by a pulse motor 9 (refer to FIG. 4). Between the roller pairs I1 and 12, three platen rollers 13, 14, and 15 are provided in this order from the roller pair 11 side. Above the platen rollers 13 to 15, there are provided a thermal head for the yellow layer (first thermal head) 16, a thermal head for magenta layer (second thermal head) 17, and a thermal head for the cyan layer (third thermal head) 18 in this order from the upstream side of the transport path along which the thermal recording medium 10 is advanced. Each of the first, second, and third thermal heads 16, 17, 18 is of an elevation type and is mounted on a frame 19. A heating element array 20 is mounted on the bottom of each of the first, second and third thermal head 16 to 18 as shown in FIG. 4. As well known in the art and shown in FIG. 4, the heating element array 20 has a plurality of heating elements 46*a*, 46*b*, . . . arranged in a line in the direction perpendicular to the transport direction of the thermal recording medium 10.

A fixing lamp 25 for the yellow layer is mounted between the first and second thermal heads 16 and 17, and a fixing lamp 26 for the magenta layer is mounted between the second and third thermal heads 17 and 18. The fixing lamp 25 for the yellow layer is an ultraviolet lamp in a long shape having a light emission peak at 420 nm, and the fixing lamp 26 for the magenta layer is an ultraviolet lamp having a light emission peak at 365 nm. These fixing lamps 25 and 26 are set within lamp houses defined by the first, second and third thermal heads 16 to 18 and the frame 19, so that light is shielded from the outside of the lamp houses.

Figure 2:
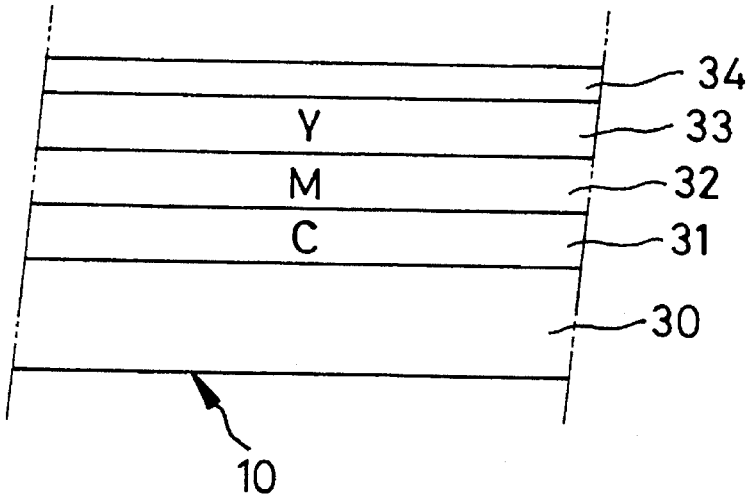
FIG. 2 illustrates an example of the layered structure of thermal recording medium.

FIG. 2 illustrates an example of the thermal recording medium 10. A cyan thermosensitive coloring layer 31, magenta thermosensitive coloring layer 32, a yellow thermosensitive coloring layer 33, and a protection layer 34 are laminated on a supporting material 30 in this order from the side of the supporting material 30. These coloring layers 31 to 33 are laminated in the order of thermal recording from the top side of the thermal recording medium 10. For example, if thermal recording is carried out in the order of magenta, yellow, and cyan, the yellow thermosensitive coloring layer and the magenta thermosensitive coloring layer are changed in position. Since the thermosensitivity is lower at the lower layer, it is possible to selectively color the three thermosensitive coloring layers 31 to 33 by changing the coloring heat energy. An intermediate layer may be provided between respective coloring layers.

The cyan thermosensitive coloring layer 31 is the bottom layer with the lowest thermosensitivity. It is therefore necessary to supply a large bias heat energy by performing bias heating for a longer time period. On the other hand, a lower bias heat energy is applied to the magenta and yellow thermosensitive coloring layers 32 and 33 which are nearer to the upper surface. According to an embodiment of the present invention, voltages V1 and V2 are used for the yellow and magenta thermosensitive coloring layers 33 and 32 having the highest and next highest heat sensitivities, and are set lower than a voltage V3 to be used for the cyan thermosensitive coloring layer 31 for the thermal recording of each pixel.

If thermal recording for the next pixel is carried out immediately after recording the preceding pixel, the next pixel develops color by accumulated heat in the heating element even if a dot is not intended to be recorded in this pixel. This coloring caused by thermal hysteresis is called a tailing phenomenon. The cooling times T5*y* and T5*m* for the thermal recording of the yellow and magenta thermosensitive coloring layers 33 and 32 are set shorter than the cooling time T5*c* for the thermal recording of the cyan thermosensitive coloring layer 31, within the range for allowing the thermal hysteresis of each thermal head to be relieved. T1 is one recording cycle for recording one pixel.

A short cooling time T4 is provided between image pulses because the life time of a thermal head is shortened if each heating element is continuously driven. Cooling times T4*y* and T4*m* are set shorter than a cooling time T4*c*.

Time durations T3*y* and T3*m* of image pulses for the yellow and magenta images and/or their bias pulse durations T2*y* and T2*m* are set longer than a time duration T3*c* of the image pulse for the cyan image and/or its bias pulse duration T2*c*. It is therefore possible in the thermal recording of cyan and magenta to prevent the energy efficiency from being lowered by a cooling time T5 which is too long. The affix "y" added to each time T1 to T5 indicates yellow image recording, the affix "m" indicates magenta image recording, and the affix "c" indicates cyan image recording.

FIG. 4 is an electric circuit diagram of the color thermal printer. An image data input unit 40 is constructed of a color scanner, an electronic color still camera, or the like, and sends image data of three colors, red, green, and blue, to a data processor 41. This data processor 41 performs color correction, gradation correction, and the like for each color data. Each processed color image data is sent to a frame memory 42 and is stored therein separately for each color. For the thermal recording, three color image data are read from the frame memory 42 one line after another, and are written in a line memory 43. Each color image data of one line read from the line memory 43 is sent to a drive data generator unit 44 to convert each color data into drive data of complementary a color. Drive data for one pixel includes a bias drive data for generating bias heat energy and an image drive data for generating heat energy for reproducing gradation.

Drive data of one line for yellow, for example, is supplied to a head driver 45 to control power to be supplied to heating elements 46*a* to 46*n* of the heating element array 20. These heating elements 46*a* to 46*n* are arranged in a line in the main scan direction, and are given a relative motion to the thermal recording medium 10 in the sub-scan direction. A controller 47 performs a sequential control of each circuit component, and controls the pulse motor 9 via a driver 48 to rotate the transport roller pairs 11 and 12 and transport the thermal recording medium 10 at a constant speed. In FIG. 4, the magenta thermal head 17 and the cyan thermal head 18 are omitted.

Figure 5:
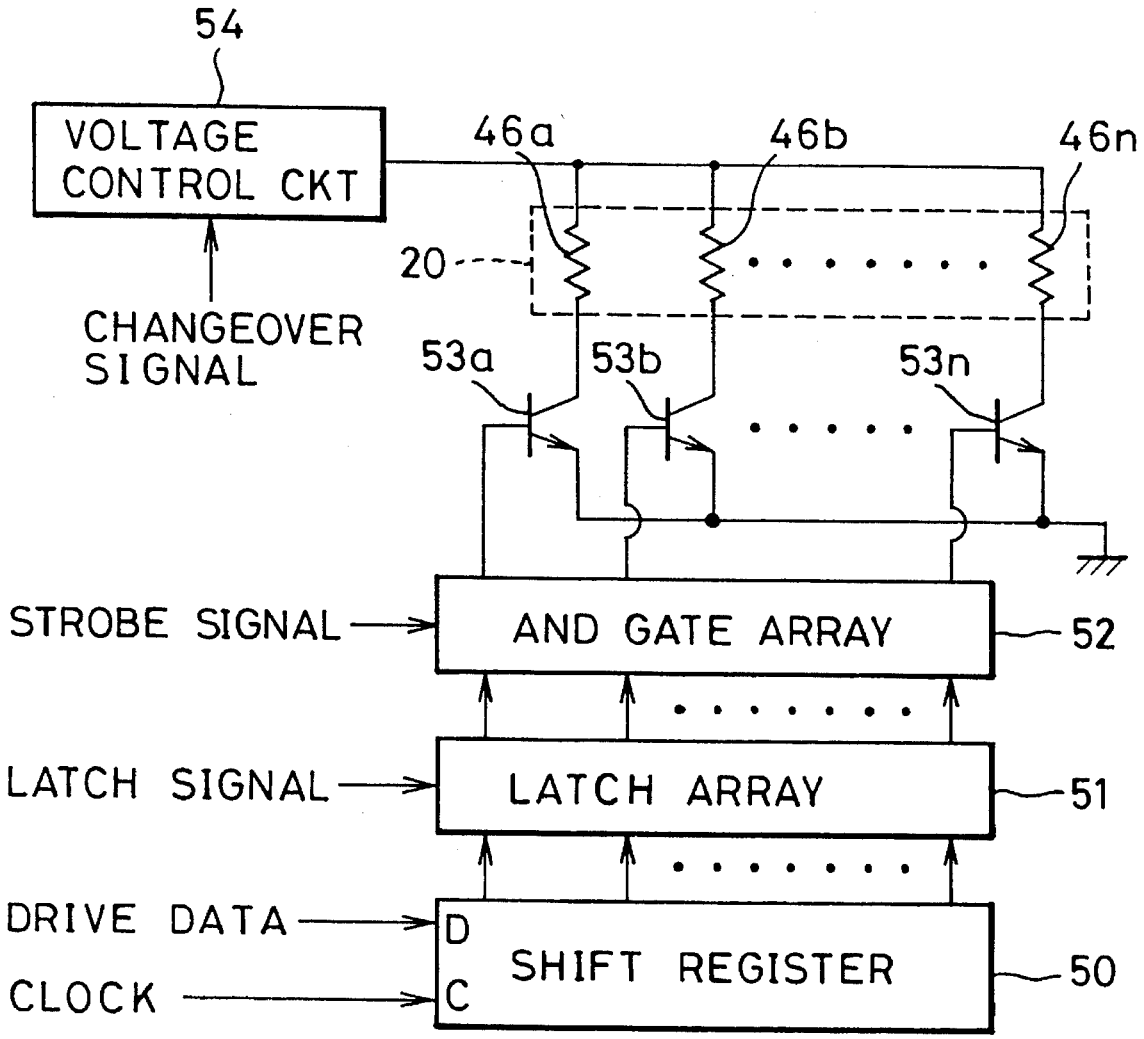
FIG. 5 is a circuit diagram of a head driver and a heating element array for an embodiment of the present invention.

FIG. 5 shows an example of the head driving unit 45. Serial drive data of one line is sent to shift register 50 synchronously with a clock signal, and is converted into parallel signals. Parallel drive data converted by the shift register 50 is latched by a latch array 51 in response to a latch signal. An AND gate array 52 outputs an "H" signal in response to an inputted strobe signal, when the latched signal is "H". Transistors 53*a* to 53*n* are connected to output terminals of the AND gate array 52. When an "H" level signal is supplied from the output terminal of the AND gate array 52, the corresponding one of the transistors 53*a* to 53*n* is turned ON. These transistors 53*a* to 53*n* are connected via The heating elements 46*a* to 46*n* to a voltage control circuit 54 which outputs a voltage corresponding to the color to be recorded, in response to a switching signal from the controller 47. The voltage control circuit 54 is constructed of, e.g., serially connected three resistors, an output line connected to the interconnection point between the second and third resistors, and two power transistors respectively connected in parallel to the first and second resistors. With this circuit arrangement, three different voltages can be selectively outputted by turning OFF the first and second power transistors, turning ON the first power transistor while turning OFF the second power transistor, or turning ON the first and second power transistors.

Figure 3:
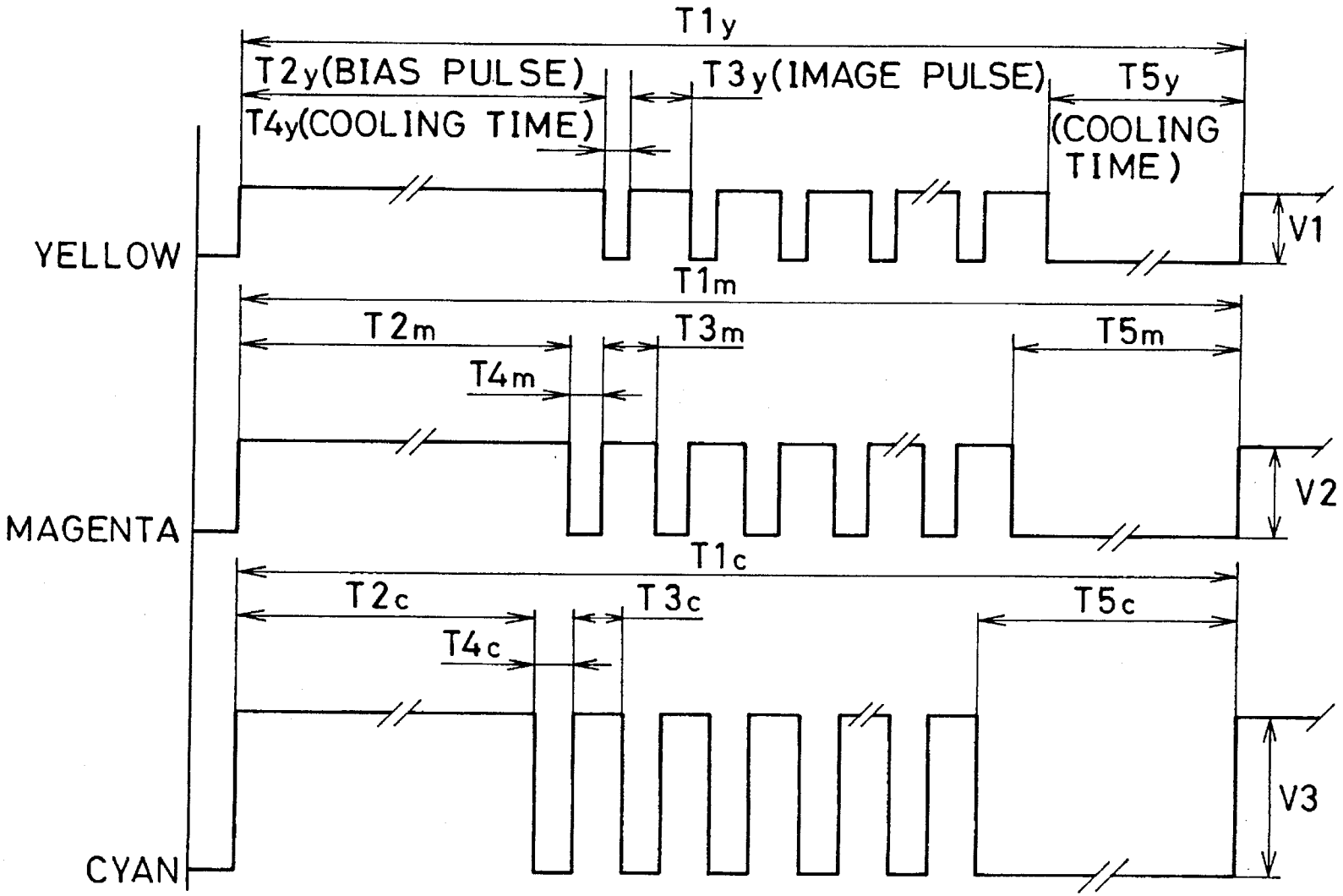
FIG. 3 shows waveforms of drive pulses for driving thermal heads.

As shown in FIG. 3, for the thermal recording of the yellow thermosensitive coloring layer 33, voltage V1 is used to drive the first thermal head 16. For the thermal recording of the magenta and cyan thermosensitive coloring layers 32 and 31, voltages V2 and V3 are used to drive the second and third thermal heads 17 and 18, respectively.

Drive data of one line is obtained in the drive data generator 44, in the following manner. First, for the bias heating, drive data of "H" is assigned to all pixels of one line, and then serial drive data is obtained. With drive data of "H", each heating element is heated. Next, the image data for each pixel is compared with a comparable data representing the first step of gradation, to determine if the pixel is to be driven. If the pixel is to be driven, "H" is assigned, and if the pixel is not to be driven, "L" is assigned. Such a comparison is performed for all pixels of one line to convert the image data into serial drive data. Using this serial drive data, the heating elements 46*a* to 46*n* are selectively driven. Similarly, the image data for each pixel is compared with a comparable data representing the second step of gradation, to convert the image data into serial drive data. For example, in the case of 64 steps of gradation, drive data of one line including bias heating drive data is read stepwise at 65 times, and the heating elements 46*a* to 46*n* are selectively driven in response to the 65th strobe signal to reproduce an image of 64-step gradation.

Figure 6:
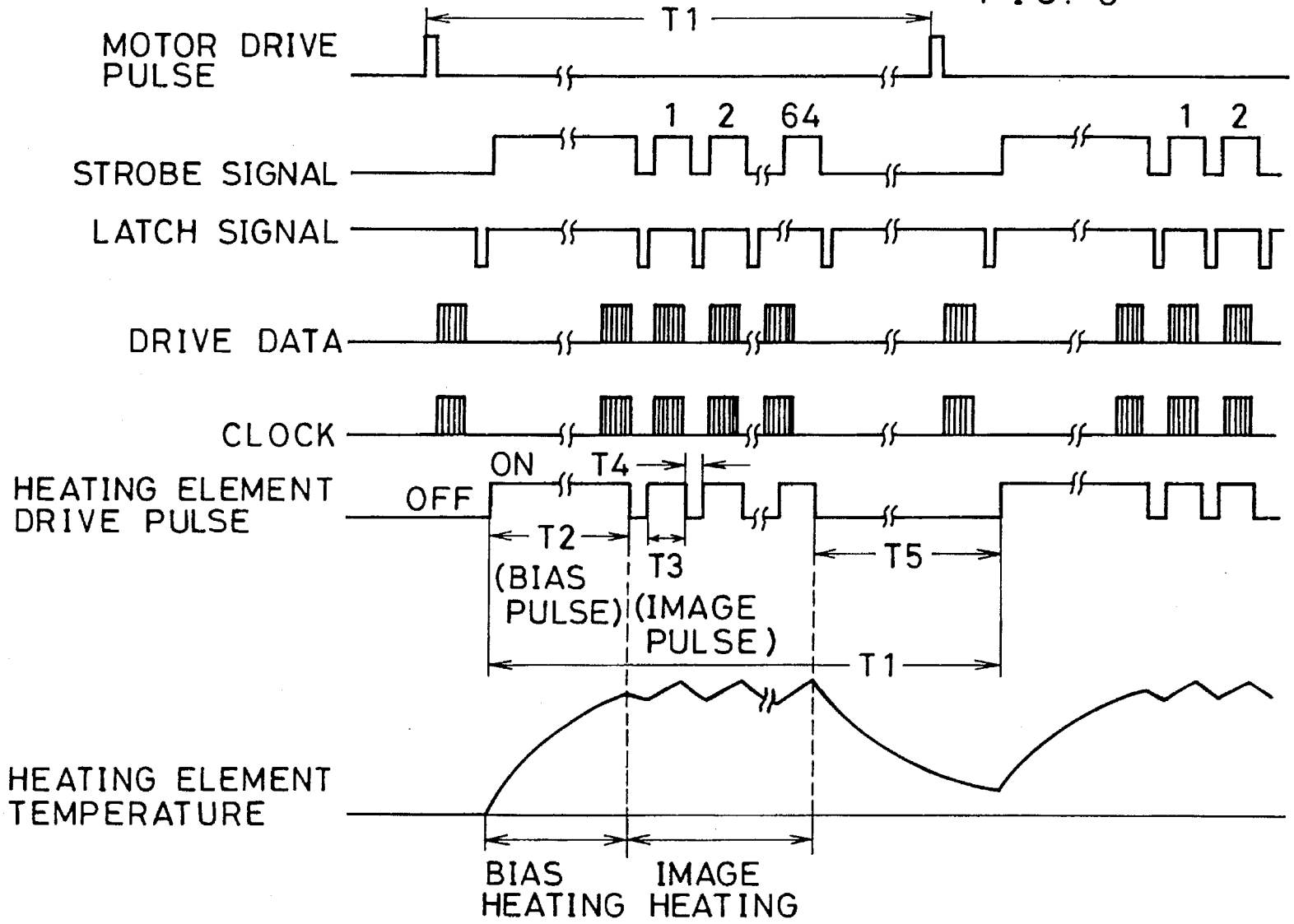
FIG. 6 show waveforms of signals supplied to the head driver.

FIG. 6 shows signal waveforms at various circuit points. T1 represents a time required for the thermal recording of one pixel. Because of the transport mechanism for the thermal recording medium in the one-pass method, the thermal recording is carried out substantially at the same timing for all colors. T2 represents a bias pulse width (bias heating time). T3 represents an image pulse width (image pulse time) T4 and T5 represent cooling times. The pulse widths T2 and T3 are determined by the pulse width of the strobe signal. In a conventional case where applied voltages are the same for all three colors, the pulse widths T2 and T3 would be set narrower for the higher heat sensitivity, so that T5*y* and T5*m* would be longer than T5*c*. However, according to an embodiment of the present invention using the one-pass method, the thermal recording is rapid and is the same for all three colors. Therefore, in order to change heat energy to be applied to each thermosensitive coloring layer, the voltage to be applied to the thermal head or the mean resistance of heating elements, is changed, and in order to obtain the heat energy necessary for thermal recording, T2 and T3 are set independently for each coloring layer.

The operation of the color thermal printer will be briefly described for the case where application voltages are varied between three colors. For the thermal recording, each image data supplied from the image data input unit 40 is processed by the image processor 41, and written in the frame memory 42 separately for each color. The thermal recording medium 10 is sent to the first, second and third thermal heads 16, 17, and 18.

While the transport roller pairs 11 and 12 intermittently rotate by a predetermined step at a time, the top of the recording area of the thermal recording medium 10 reaches the first thermal head 16. At this time, the thermal recording of a yellow image starts. Yellow image data of one line is read from the frame memory 42 and temporarily stored in the line memory 43. Next, the image data is read from the line memory 43, and sent to the drive data generator unit 44 which generates signals such as the signals shown in FIG. 3 and sends the signals to the head driver 45. For the thermal recording of a yellow image, the application voltage V1 is set lowest among the three colors, and T2 and T3 are set longer in correspondence with the lowered degree of V1. The cooling time T5 is set short within the range for allowing the thermal hysteresis to be relieved. If T4 and T5 can be set sufficiently short, T2 and T3 are not necessarily set longer. The head driver 45 drives the heating elements **46*a* to 46*n* to supply the bias heat energy and gradation heat energy corresponding to the image data to thereby develop colors of a desired density. After the first line of the yellow image is recorded, the transport roller pairs 11 and 12 are stepwise rotated by one pixel amount by the pulse motor 9. Then, the second line image data of the yellow image is read from the frame memory 42. In the similar manner, the yellow image of third the and following lines is thermally recorded on the thermal recording medium 10. When the thermally recorded yellow image reaches the fixing lamp 25 for the yellow layer, the yellow thermosensitive coloring layer 33** is optically fixed.

Next, the magenta image is recorded one line after another in the same manner as described above by the second thermal head 17. For the thermal recording of the magenta image, the application voltage V2 is set to the second lowest level, and the cooling times T4 and T5 are set correspondingly shorter within the range for allowing the thermal hysteresis to be relieved. The magenta image is optically fixed by the fixing lamp 26 for the magenta layer in the same manner as described above. During recording of the magenta image, although the yellow thermosensitive coloring layer 33 is also heated, the capacity for coupling has already been lost, so that no additional color will be developed in the yellow thermosensitive coloring layer 33.

Next, the cyan image is thermally recorded one line after another by the third thermal head 18. For the thermal recording of the cyan image, the application voltage V3 is set higher than voltages for any other color. The cyan thermosensitive coloring layer 31 requires high heat energy to be colored, and no color will be developed under the normal storing condition. Therefore, optical fixation for the cyan thermosensitive coloring layer 31 is omitted. In the above manner, the thermosensitive coloring layers are thermally recorded by the first, second and third thermal heads 16 to 18 by passing the thermal recording medium 10 once through the transport path, and thereafter the thermal recording medium 10 exits onto a tray.

In the foregoing description, the application voltage to each thermal head is different. Instead, the resistances of heating elements may be changed for each thermal head. Namely, the average or mean resistance values are set as R1>R2>R3, where R1 is a mean resistance value of heating elements of the first thermal head 16 for the thermal recording of the yellow thermosensitive coloring layer 33, R2 is a mean resistance value of heating elements of the second thermal head 17 for the thermal recording of the magenta thermosensitive coloring layer 32, and R3 is a mean resistance value of heating elements of the third thermal head 18 for the thermal recording of the cyan thermosensitive coloring layer 31.

The resistance can be set to a desired value by changing the thickness of a heating element, or changing the material of a heating element. Even if a healing element is manufactured to have a designed resistance value, it is not possible in practice to have the same value for all heating elements, and there are some variations of resistance values. The resistances of heating elements of each thermal head are therefore represented by the mean resistance value.

In the above embodiment, three thermosensitive coloring layers are used. The number of layers may be two, four, five, or more. In this case, thermal heads which are the same in number as that of coloring layers, are used. Furthermore, a line printer in which a number of heating elements are arranged in the main scan direction and the thermal recording medium is moved in the sub-scan direction for the thermal recording, has been described. The present invention is also applicable to a serial printer in which three thermal heads are moved in unison in the transversal direction of a thermal recording medium. Still further, the cyan, magenta, and yellow thermosensitive coloring layers are laminated on a supporting material in this order from the supporting material side. The order of layer lamination may be changed optionally. In this case, the characteristic of being optically fixable in the bottom thermosensitive coloring layer can be omitted. Obviously, optical fixability may be provided for the bottom layer.

In the foregoing description, a separate thermal head has been used for each color. An integrated thermal head assembly having three arrays of heating elements may be used as disclosed in Japanese Patent Laid-open Publication No. 61-227067. In this case, ultraviolet rays are emitted through slits formed between thermal heads. Furthermore, three thermal heads are powered substantially at the same timing in the above embodiment. The present invention is also applicable to the case where two thermal heads are powered substantially at the same timing.

Figure 7:
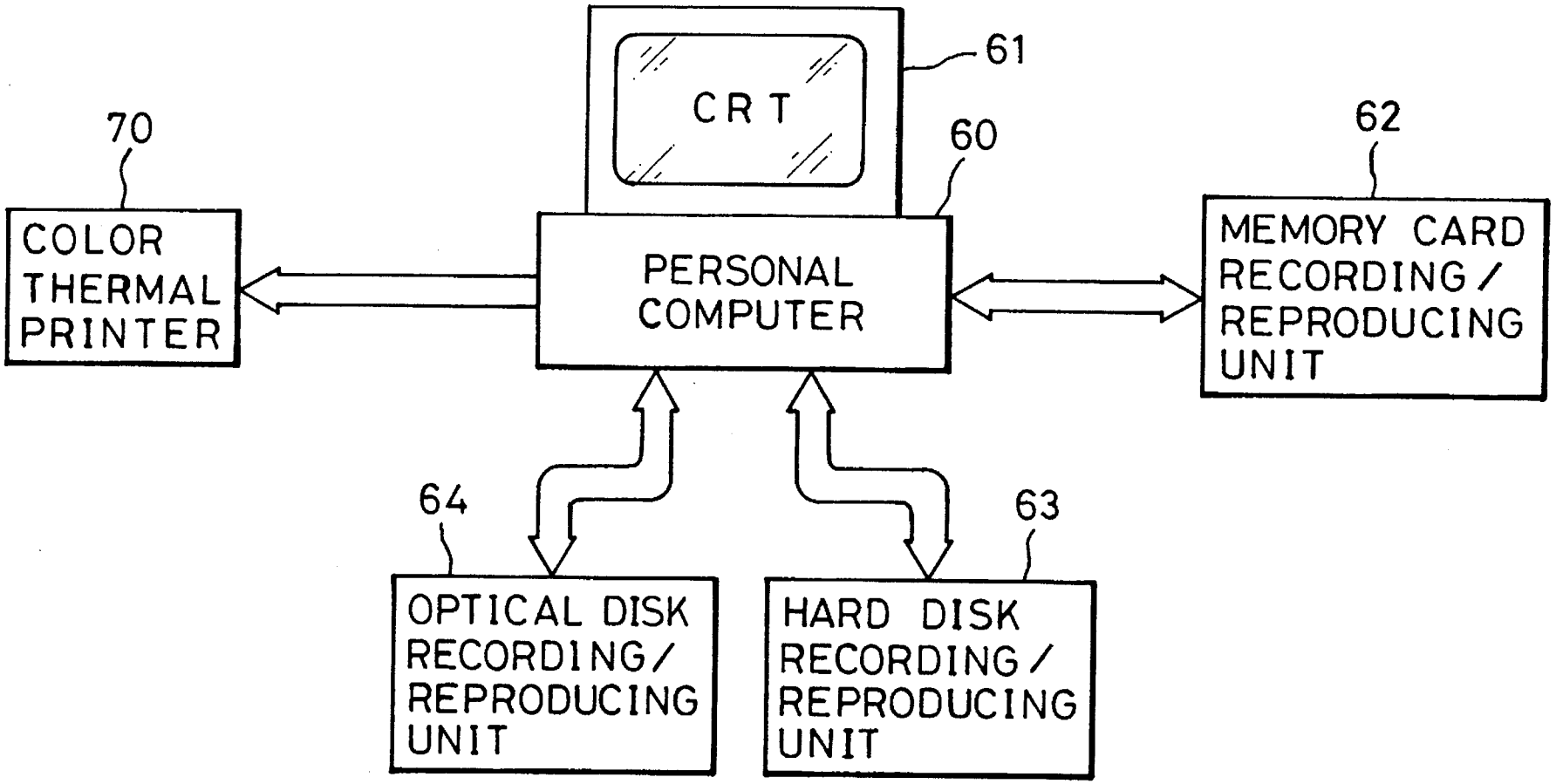
FIG. 7 illustrates a thermal printer system for an embodiment of the present invention.
Figure 8:
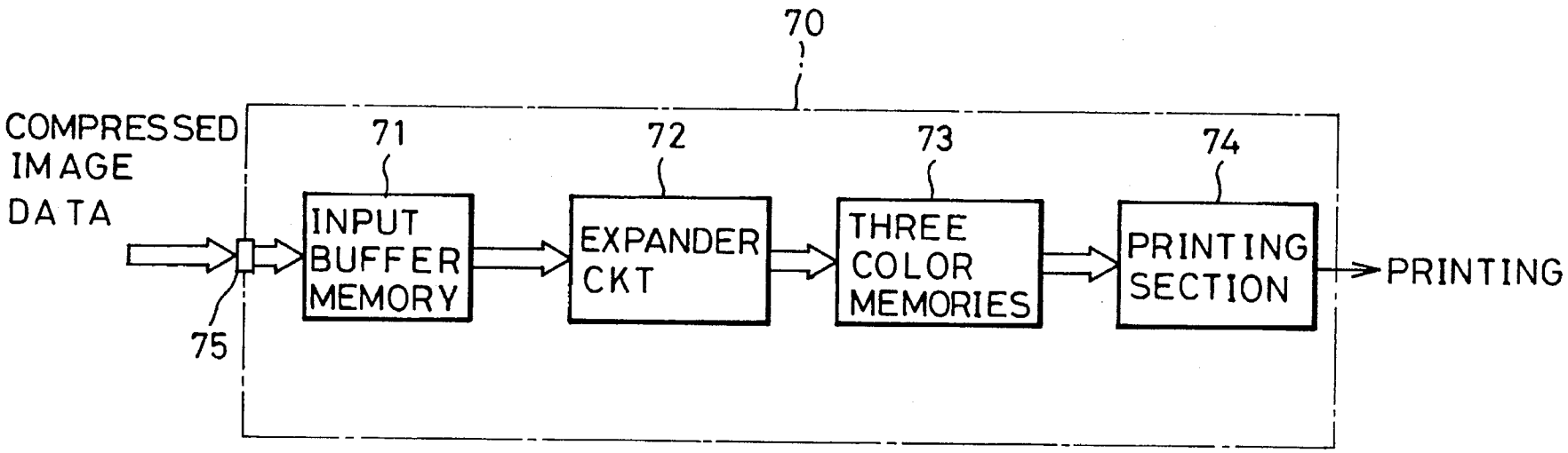
FIG. 8 is a block diagram of the color thermal printer shown in FIG. 7.

FIGS. 7 and 8 illustrate a thermal printer system capable of shortening an image data transfer time. Referring to FIG. 7, the operation of the thermal printer system is supervised or controlled by a personal computer 60. Digital image data taken by an electronic still camera for example is written in a memory card, a hard disk, or an optical disk. These image data storage media are loaded in a memory card recording/reproducing unit 62, a hard disk recording/reproducing unit 63, and an optical disk recording/reproducing unit 64. Image data read from the memory card recording/reproducing unit 62, the hard disk recording/reproducing unit 63 or the optical disk recording/reproducing unit 64 is displayed on a CRT display 61, or directly printed on a thermal recording medium by a color thermal printer 70.

Referring to FIG. 8, the color thermal printer 70 receives compressed digital image data from an input terminal 75. This image data is expanded and printed out on a thermal recording medium. For this purpose, the color thermal printer 70 has an input buffer memory 71 for temporarily storing digital image data and an expander circuit 72. The color thermal printer 70 also has three color memories 73 for converting expanded digital data into red (R), green (G), and blue (B) data and outputting the expanded digital data, and the color thermal printer 70 further has a printing section 74.

Digital image data is written in a memory card, a hard disk, or an optical disk, in the form of compressed image data. Therefore, compressed digital image data is transferred between the personal computer 60 and the memory card recording/reproducing unit 62, the hard disk recording/reproducing unit 63, or the optical disk recording/reproducing unit 64.

In producing a hard copy of image data by supplying the color thermal printer 70 with compressed digital image data recorded in the memory card compressed digital image data is read from the memory card using the memory card recording/reproducing unit 62. The read-out compressed image data is transferred from the memory card recording/reproducing unit 62 to the personal computer 60, and to the color thermal printer 70.

Referring to FIG. 8, compressed digital image data supplied to the color thermal printer 70 via the input terminal 75 is inputted to the input buffer memory 71 and temporarily stored therein. The compressed digital image data read from the input buffer memory 71 is supplied to the expander circuit 72 to expand the image data. The expanded digital image data is temporarily stored in the three color memories 73.

Three color memories 73 output red image data (R), green image data (G), and blue image data (B) corresponding to the inputted digital image data to the printing section 74. At the printing section 74, the three color image data are converted to yellow, magenta, and cyan image data, and the first, second and third thermal heads 16, 17 and 18 are driven in the manner described previously to directly print a full-color image on a thermal recording medium.

Since compressed digital image data is transferred to the color thermal printer 70, the data transfer time can be made shorter than when transferring non-compressed digital image data. Because of compressed digital image data, the capacity of the input buffer memory 71 can be made smaller than when transferring non-compressed digital image data.

In the description of this embodiment, compressed digital image data recorded in a memory card is transferred to the color thermal printer 70 to print the compressed digital image data out. The operation when printing compressed digital image data recorded in a hard disk or an optical disk, is the same as the above operation for a memory card. Image data written in a memory card or the like can be reproduced and displayed on the CRT display 61. In this case, compressed digital image data read from the memory card recording/reproducing unit 62 the hard disk recording/reproducing unit 63, or the optical disk recording/reproducing unit 64 is supplied to the personal computer 60 to expand the image data. The expanded image data is converted to analog video signals and displayed on the CRT display 61.

Although the present invention has been described with reference to the preferred embodiments shown in the drawings, the invention should not be limited by the embodiments but, on the contrary, various modifications, changes, combinations and the like of the present invention can be effected without departing from the spirit and scope of the appended claims.

We claim:

1. A color thermal printing method for printing a multi-color image comprising the steps of:

(a) passing a color thermal recording medium once through a transport path along which a predetermined number of thermal heads and a predetermined number of light sources are arranged, said predetermined number of light sources being one less than said predetermined number of thermal heads, the color thermal recording medium having a predetermined number of thermosensitive coloring layers wherein each of said thermosensitive coloring layers develops a different color;

(b) after a first top thermosensitive coloring layer of said predetermined number of said thermosensitive coloring layers is thermally recorded using a first of said predetermined number of said thermal heads, optically fixing said thermosensitive coloring layer by radiating electromagnetic rays specific to said first top thermosensitive coloring layer from a first of said light sources;

(c) after a second thermosensitive coloring layer of said predetermined number of said thermosensitive coloring layers adjacent to said first thermosensitive coloring layer is thermally recorded using a second of said predetermined number of said thermal heads, optically fixing said second thermosensitive coloring layer by radiating electromagnetic rays specific to said second thermosensitive coloring layer from a second of said light sources;

(d) repeating thermal recording and optical fixing operations until a bottom thermosensitive coloring layer of said predetermined number of thermosensitive coloring layers is thermally recorded using one of said thermal heads corresponding to a last of said predetermined number of said thermal heads;

(e) setting a condition of $P1<P2<\ldots<Pn$, where P1 is a power to be generated in said first thermal head, P2 is a power to be generated in said second thermal head, etc., and Pn is a power to be generated in one of said thermal heads corresponding to a last of said predetermined number of said thermal heads; and (f) setting a relatively long cooling time between recording a pixel and recording the next pixel, in order to prevent a tailing phenomenon.

2. The color thermal printing method for printing a multi-color image of claim 1 wherein said step of setting a condition establishes a condition of $V1<V2<\ldots Vn$, where V1 is a voltage to be applied to said first thermal head, V2 is a voltage to be applied to said second thermal head, etc., and Vn is a voltage to be applied to said one of said thermal heads corresponding to a last of said predetermined number of said thermal heads.

3. A color thermal printing method according to claim 2, wherein each of said predetermined number of thermal heads includes a plurality of heating elements arranged in a line in a direction perpendicular to a transporting direction of transporting said color thermal recording medium.

4. A color thermal printing method according to claim 1, wherein each one of said light sources is provided between two of said thermal heads.

5. A color thermal printing method according to claim 2, wherein said predetermined number is 3, and said first top thermosensitive coloring layer comprises a yellow thermosensitive coloring layer, said second thermosensitive coloring layer comprises a magenta thermosensitive coloring layer, and said bottom thermosensitive coloring layer comprises a cyan thermosensitive coloring layer.

6. A color thermal printing method according to claim 5, wherein said yellow thermosensitive coloring layer is optically fixed by ultraviolet rays of substantially 420 nm, and said magenta thermosensitive coloring layer is optically fixed by ultraviolet rays having peak wave lengths of 365 nm.

7. A color thermal printing method according to claim 2, wherein each of said thermal heads extends in a direction perpendicular to a top surface of said color thermal recording medium so as to shield said electromagnetic rays.

8. A color thermal printing method according to claim 2, further comprising the steps of supplying each of said thermal heads with a bias pulse for heating each of said thermosensitive coloring layers to a temperature just near to a coloring temperature and supplying image pulses corresponding in number to a coloring density, for a thermal recording of one pixel.

9. The color thermal printing method for printing a multi-color image of claim 1 wherein said step of setting a condition establishes a condition of R1>R2> . . . >Rn, where R1 is a mean resistance value of heating elements of said first thermal head, R2 is a mean resistance value of heating elements of said second thermal head, etc., and Rn is a mean resistance value of heating elements of said one of said thermal heads corresponding to a last of said predetermined number of said thermal heads.

10. A color thermal printing method according to claim 9, wherein each of said thermal heads includes a number of heating elements arranged in a line in a direction perpendicular to a transporting direction of said color thermal recording medium.

11. A color thermal printing method according to claim 9, wherein each one of said light sources is provided between two of said thermal heads.

12. A color thermal printing method according to claim 9, wherein said predetermined number is 3, and said first top thermosensitive coloring layer comprises a yellow thermosensitive coloring layer, said second thermosensitive coloring layer comprises a magenta thermosensitive coloring layer, and said bottom thermosensitive coloring layer comprises a cyan thermosensitive coloring layer.

13. A color thermal printing method according to claim 12, wherein said yellow thermosensitive coloring layer is optically fixed by ultraviolet rays of substantially 420 nm, and said magenta thermosensitive coloring layer is optically fixed by ultraviolet rays having peak wave lengths of 365 nm.

14. A color thermal printing method according to claim 9, wherein each said thermal heads extends in a direction perpendicular to a top surface of said color thermal recording medium so as to shield said electromagnetic rays.

15. A color thermal printing method according to claim 9, further comprising the steps of supplying each of said thermal heads with a bias pulse for heating each of said thermosensitive coloring layers to a temperature just near to a coloring temperature and supplying image pulses corresponding in number to a coloring density, for a thermal recording of one pixel.

16. The color thermal printing method of claim 1, further comprising setting a cooling time for the thermal recording of a first top thermosensitive coloring layer shorter than a cooling time for the thermal recording of said bottom thermosensitive coloring layer.

17. A color thermal printing method according to claim 16, wherein said setting step comprises:

obtaining a minimum value of a cooling time at which said tailing phenomenon is prevented even when respectively said thermosensitive coloring layers are heated to develop maximum density; and setting said cooling time for the thermal recording of respective said thermosensitive coloring layers longer than said minimum value.

18. A color thermal printer for printing a multi-color image comprising:

a color thermal recording medium, which is passed once through a transport path by transport roller pairs, said color thermal recording medium including a predetermined number of thermosensitive coloring layers wherein each of said thermosensitive coloring layers develops a different color;

a predetermined number of thermal heads arranged along said transport path for thermally recording each of said predetermined number of thermosensitive coloring layers, wherein a first top thermosensitive coloring layer of said predetermined number of thermosensitive coloring layers is thermally recorded by a first of said predetermined number of thermal heads and a second thermosensitive coloring layer of said predetermined number of thermosensitive coloring layers adjacent to said first thermosensitive coloring layer is thermally recorded by a second of said predetermined number of thermal heads and each of said predetermined number of thermosensitive coloring layers is thermally recorded by one of said predetermined number of thermal heads until a bottom thermosensitive coloring layer is reached and thermally recorded by one of said thermal heads corresponding to said predetermined number;

a predetermined number of light sources which is one less than said predetermined number of said thermal heads arranged along said transport path for optically fixing each of said predetermined number of thermosensitive coloring layers by radiating electromagnetic rays specific to each of said predetermined number of thermosensitive coloring layers after thermally recording the corresponding thermosensitive coloring layer, wherein said first top thermosensitive coloring layer is optically fixed by radiating electromagnetic rays specific to said first top thermosensitive coloring layer from a first of said light sources after said first top thermosensitive coloring layer is thermally recorded, said second thermosensitive coloring layer is optically fixed by radiating electromagnetic rays specific to said second thermosensitive coloring layer from a second of said light sources and each of said predetermined number of thermosensitive coloring layers excluding said bottom thermosensitive coloring layer is optically fixed by respective ones of said light sources;

setting means for setting a condition of P1<P2< . . . <Pn, where P1 is a power to be generated in said first thermal head, P2 is a to be generated in said second thermal head, etc., and Pn is a power to be generated in one of said thermal heads corresponding to a last of said predetermined number of thermal heads; and cooling time setting means for setting a relatively long cooling time between recording a pixel and recording the next pixel in order to prevent a tailing phenomenon.

19. A color thermal printer according to claim 18, wherein each of said predetermined number of thermal heads includes a plurality of heating elements arranged in a line in a direction perpendicular to a transporting direction of said color thermal recording medium.

20. A color thermal printer according to claim 18, wherein each one of said light sources is provided between two of said thermal heads.

21. A color thermal printer according to claim 18, wherein said predetermined number is 3, and said first top thermosensitive coloring layer comprises a yellow thermosensitive coloring layer, said second thermosensitive coloring layer comprises a magenta thermosensitive coloring layer and said bottom thermosensitive coloring layer comprises a cyan thermosensitive coloring layer.

22. A color thermal printer according to claim 21, wherein said yellow thermosensitive coloring layer is optically fixed by ultraviolet rays of substantially 420 nm, and said magenta thermosensitive coloring layer is optically fixed by ultraviolet rays of having peak wavelengths of 365 nm.

23. A color thermal printer according to claim 18, wherein each of said thermal heads extends in a direction perpendicular to a top surface of said color thermal recording medium so as to shield said electromagnetic rays.

24. A color thermal printer according to claim 18, further comprising:

bias pulse supplying means for supplying each of said thermal heads with a bias pulse for heating each of said thermosensitive coloring layers to a temperature just near to a coloring temperature; and image supplying means for supplying image pulses corresponding in number to a coloring density for a thermal recording of one pixel.

25. The color thermal printer of claim 18 wherein said setting means establishes a condition of $V1<V2< \ldots <Vn$, where V1 is a voltage to be applied to said first thermal head, V2 is a voltage to be applied to said second thermal head, etc., and Vn is a voltage to be applied to one of said thermal heads corresponding to a last of said predetermined number of said thermal heads.

26. The color thermal printer of claim 18 wherein said setting means establishes a condition of $R1>R2> \ldots >Rn$, where R1 is a mean resistance value of heating elements of said first thermal, R2 is a mean resistance value of heating elements of said second thermal head, etc., and Rn is a mean resistance value of heating elements of said one of said thermal heads corresponding to a last of said predetermined number of said thermal heads.

27. The color thermal printer of claim 18, wherein said cooling time setting means sets a cooling time the thermal recording of said first top thermosensitive coloring layer shorter than a cooling time for the thermal recording in said one of said thermal heads corresponding to said predetermined number of thermal heads.

* * * * *